US009284785B2

(12) United States Patent
Haugvaldstad

(10) Patent No.: US 9,284,785 B2
(45) Date of Patent: Mar. 15, 2016

(54) DRILL BITS HAVING DEPTH OF CUT CONTROL FEATURES AND METHODS OF MAKING AND USING THE SAME

(71) Applicant: SMITH INTERNATIONAL, INC., Houston, TX (US)

(72) Inventor: Kjell Haugvaldstad, Vanvikan (NO)

(73) Assignee: Smith International, Inc., Houston, TX (US)

( * ) Notice: Subject to any disclaimer, the term of this patent is extended or adjusted under 35 U.S.C. 154(b) by 345 days.

(21) Appl. No.: 13/829,815

(22) Filed: Mar. 14, 2013

(65) Prior Publication Data

US 2013/0270010 A1 Oct. 17, 2013

Related U.S. Application Data

(60) Provisional application No. 61/622,749, filed on Apr. 11, 2012.

(51) Int. Cl.

| | |
|---|---|
| ***E21B 10/43*** | (2006.01) |
| ***E21B 10/46*** | (2006.01) |
| ***E21B 12/04*** | (2006.01) |

(52) U.S. Cl.
CPC ..... *E21B 10/43* (2013.01)

(58) Field of Classification Search
CPC ..... E21B 10/43; E21B 10/46; E21B 12/04
See application file for complete search history.

(56) References Cited

U.S. PATENT DOCUMENTS

| | | | | |
|---|---|---|---|---|
| 7,693,695 | B2 | 4/2010 | Huang et al. | |
| 8,066,084 | B2 | 11/2011 | Dykstra et al. | |
| 2005/0015229 | A1 | 1/2005 | Huang | |
| 2005/0080595 | A1 | 4/2005 | Huang | |
| 2006/0278436 | A1* | 12/2006 | Dykstra et al. | 175/57 |
| 2007/0151770 | A1 | 7/2007 | Ganz | |
| 2008/0308321 | A1 | 12/2008 | Aliko et al. | |
| 2010/0263937 | A1 | 10/2010 | Overstreet et al. | |
| 2011/0000714 | A1* | 1/2011 | Durairajan et al. | 175/57 |
| 2011/0114392 | A1 | 5/2011 | Dykstra et al. | |
| 2012/0024609 | A1 | 2/2012 | Dykstra et al. | |

OTHER PUBLICATIONS

International Search Report and Written Opinion of PCT Application Serial No. PCT/US2013/036106 dated Jul. 23, 2013 pp. 1-16.

* cited by examiner

*Primary Examiner* — Blake Michener
*Assistant Examiner* — Kipp Wallace

(57) ABSTRACT

A drill bit for drilling a borehole in an earthen formation may include a bit body having a bit axis and a direction of rotation about the bit axis; at least two blades extending azimuthally from the bit body; and a plurality of cutting elements disposed on the at least two blades; the plurality of cutting elements forming a cutting profile in a rotated profile view, each cutting element having a radial distance from the bit axis. At least one blade, at its formation facing surface, may include, between two radially adjacent cutting elements on the at least one blade, a raised depth of cut feature for each cutting element on the other of the at least two blades that are at radial distances from the bit axis intermediate the radial distances from the bit axis of the radially adjacent cutting elements on the at least one blade.

13 Claims, 12 Drawing Sheets

DRILL BITS HAVING DEPTH OF CUT CONTROL FEATURES AND METHODS OF MAKING AND USING THE SAME

CROSS-REFERENCE TO RELATED APPLICATION

This application claims the benefit of U.S. Provisional Patent Application Ser. No. 61/622,749 filed Apr. 11, 2012, which is incorporated herein by reference in its entirety.

BACKGROUND

Background Art

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Many different types of drill bits and cutting structures for bits have been developed and found useful in drilling such boreholes. Two predominant types of drill bits are roller cone bits and fixed cutter bits, also known as rotary drag bits. Some fixed cutter bit designs include primary blades, secondary blades, and sometimes even tertiary blades, angularly spaced about the bit face, where the primary blades are generally longer and start at locations closer to the bit's rotating axis. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PDC bit" or "PDC cutter element" refers to a fixed cutter bit or cutting element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may impact the performance of the drill bit.

Without regard to the type of bit, the cost of drilling a borehole for recovery of hydrocarbons may be very high, and is proportional to the length of time it takes to drill to the desired depth and location. The time to drill the well, in turn, is greatly affected by the number of times the drill bit is changed before reaching the targeted formation. This is the case because each time the bit is changed, the entire string of drill pipe, which may be miles long, is retrieved from the borehole, section by section. Once the drill string has been retrieved and the new bit installed, the bit is lowered to the bottom of the borehole on the drill string, which again is constructed section by section. This process, known as a "trip" of the drill string, involves considerable time, effort and expense. Accordingly, it is desirable to employ drill bits which will drill faster and longer, and which are usable over a wider range of formation hardness.

The length of time that a drill bit may be employed before it is changed depends upon a variety of factors. These factors include the bit's rate of penetration ("ROP"), as well as its durability or ability to maintain a high or acceptable ROP.

Excessive wear of cutter elements and damage to cutter elements resulting from impact loads detrimentally impact bit ROP. Excessive wear and damage to cutter elements may arise for a variety of reasons. For example, in a soft formation layer, the cutter elements can often sustain a relatively large depth-of-cut (DOC) and associated high ROP. However, as the bit transitions from the soft formation layer to a hard formation layer, such a large depth-of-cut generally result in abrupt and unpredictable impact loads to the cutter elements, which increases the likelihood of excessive wear of the cutter elements, breakage/fracture of the cutter elements, and/or delamination of the cutter elements. As another example, instability and vibrations experienced by a downhole drill bit may result in undesirable impact loads to the cutter elements, which may chip, break, delaminate, and/or excessively wear the cutter elements. Such excessive wear and damage resulting from impact loads experienced by cutter elements generally results in a reduced ROP for a given weight-on-bit (WOB). Further, in many cases, such damage to the cutter elements is not recognized at the surface as the drilling rig attempts to further advance the bit into the formation with increased weight-on-bit (WOB), potentially damaging the bit beyond repair.

Bit balling and formation packing off can also detrimentally impact bit ROP. In particular, as formation is removed by cutter elements, drilling fluid from the bit's nozzles flushes the formation cuttings away from the bit face and up the annulus between the drill string and the borehole wall. As previously described, while drilling through soft formations the cutter elements can sustain a relatively high depth-of-cut and ROP, which results in a relatively high volume of formation cuttings. If the volume of formation cuttings is sufficiently large, the nozzles may not provide sufficient cleaning of the bit face, potentially leading to plugging of the nozzles and the junk slots between the blades by the formation cuttings (i.e., bit "balling"). In addition to bit balling, an excessive depth-of-cut may decrease the steerability of the drill bit, thereby reducing effective ROP in directional drilling applications. In particular, with a large depth-of-cut, the drill bit is continuously steered to keep the bit on course to limit and/or prevent the bit from "straying" off course.

Accordingly, there remains a desire in the art for a fixed cutter bit and cutting structure capable of enhancing bit stability, bit ROP, and bit durability. Such a fixed cutter bit would be particularly well received if it offered the potential to limit the depth-of-cut of the cutter elements to reduce the potential for abrupt impact loads and bit balling, while allowing for enhanced steerability.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a drill bit for drilling a borehole in an earthen formation that includes a bit body having a bit axis and a direction of rotation about the bit axis; at least two blades extending azimuthally from the bit body; and a plurality of cutting elements disposed on the at least two blades. At least one blade, at its formation facing surface, may include, between two radially adjacent cutting elements on the at least one blade, a raised depth of cut feature for each cutting element on the other of the at least two blades that are at radial distances from the bit axis intermediate the radial distances from the bit axis of the radially adjacent cutting elements on the at least one blade. Aspects of the embodiments disclosed herein also relate to raised depth of cut feature(s) corresponding to a bottom hole pattern including methods of manufacturing such drill bits. Methods of drilling using the drill bits having raised depth of cut features are also disclosed.

Other aspects and advantages of the claimed subject matter will be apparent from the following description and the appended claims.

DETAILED DESCRIPTION

In one aspect, embodiments disclosed herein may relate to earth-boring drill bits used to drill a borehole for the ultimate recovery of oil, gas or minerals. More particularly, embodiments disclosed herein may relate to drag bits and to stabilizing features for such bits. Still more particularly, embodiments disclosed herein may relate to a blade geometry to enhance bit stability.

Figure 1:
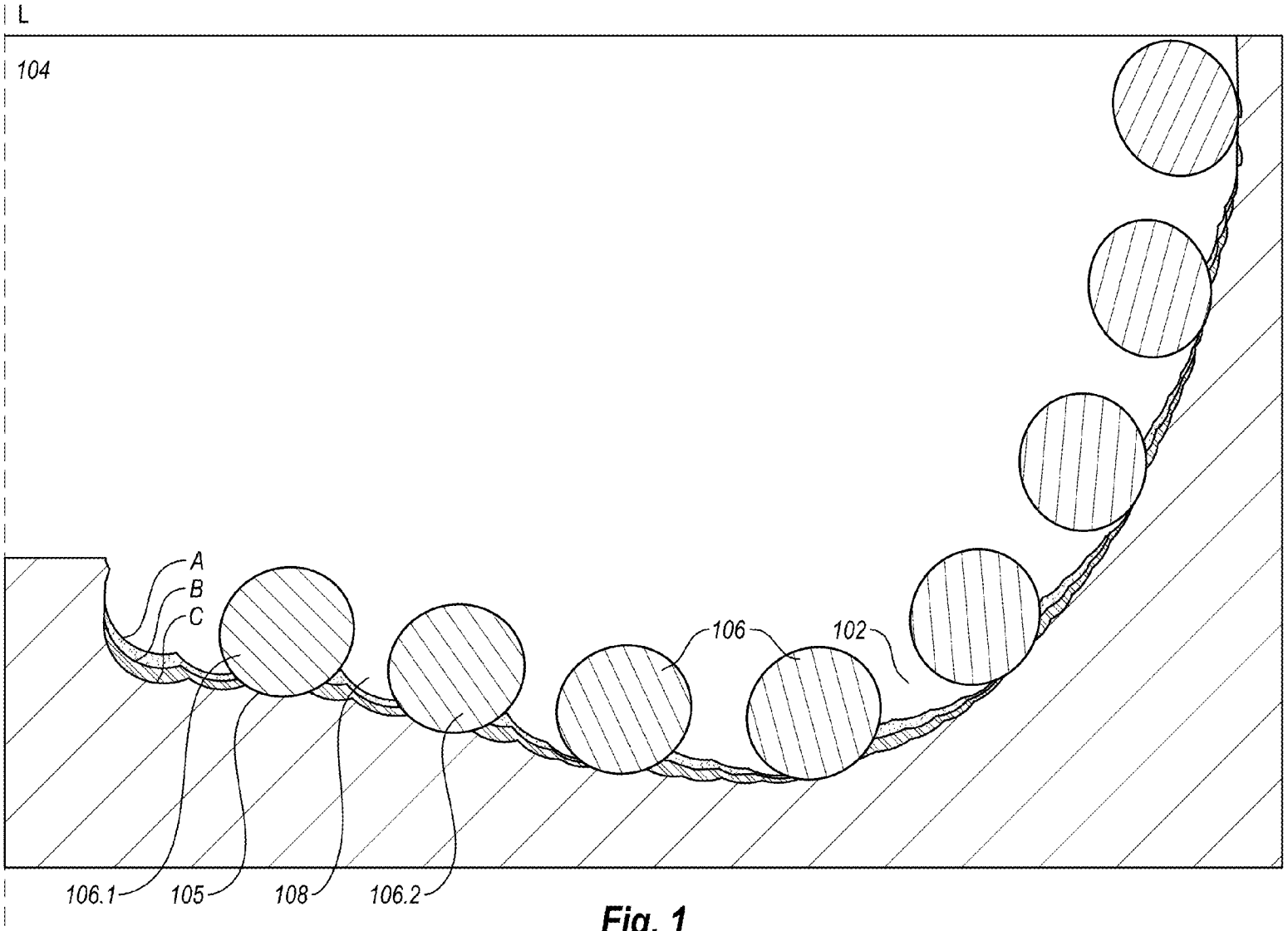
FIG. 1 is a cross-sectional view of a blade of a drill bit according to an embodiment.

Referring to FIG. 1, a cross-sectional view of a blade 102 of a drill bit (not shown) is shown. As shown in FIG. 1, blade 102 is a structure that extends from a bit body 104 of a drill bit. Blade 102 includes a plurality of cutting elements 106 disposed in cutter pockets 107 formed in blade 102. Between adjacent cutting elements 106.1 and 106.2, at least a portion of blade's 102 top or formation facing surface includes at least one raised depth of cut feature 108 therebetween. As used herein, a raised depth of cut feature refers to a portion of the blade formation facing surface that is non-uniform and/or non-smooth having either a local curvature non-equal to the overall blade curvature or a stepped profile with substantially planar raised surface. The raised depth of cut feature may be present between any two adjacent cutting elements such as in the cone region, nose region, and/or shoulder region of a blade/cutting profile. The cone, nose and shoulder region of a blade/cutting profile are illustrated in and explained with respect to FIG. 6.

Figure 6:
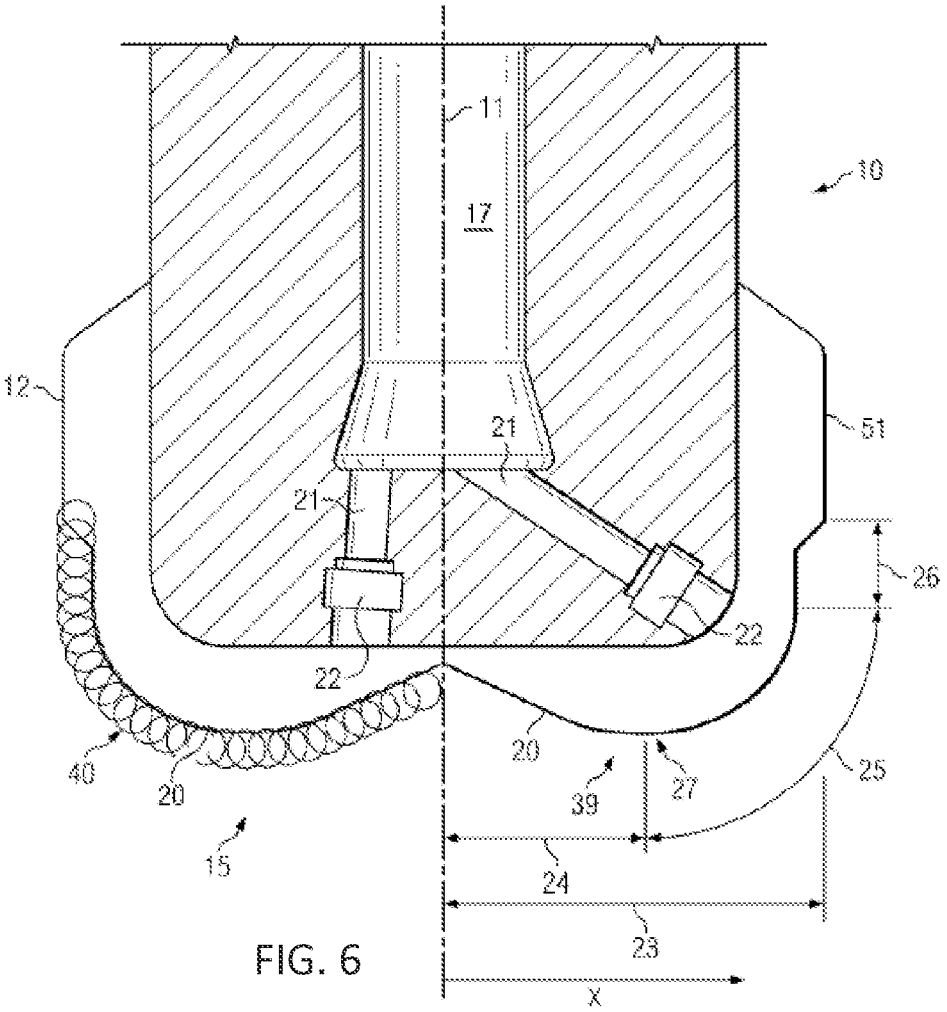
FIG. 6 is a cross-sectional view of a drill bit showing a cutting profile in a single rotated view.

Referring to FIG. 6, a profile of bit 10 is shown as it would appear with each blades (102 in FIG. 1) and associated cutter elements 40 rotated into a single rotated profile. For purposes of clarity, the rotated profile of depth-of-cut features (108 in FIG. 1) is not shown in this view.

In rotated profile view, blades of bit 10 form a combined or composite blade profile 39. Composite blade profile 39 and bit face 20 may generally be divided into three regions conventionally labeled cone region 24, shoulder region 25 and gage region 26. Cone region 24 comprises the radially innermost region of bit 10 and composite blade profile 39 extending generally from bit axis 11 to shoulder region 25. In this embodiment, cone region 24 is generally concave. Adjacent cone region 24 is shoulder (or the upturned curve) region 25. In this embodiment, shoulder region 25 is generally convex. The transition between cone region 24 and shoulder region 25, generally referred to as the nose or nose region 27, occurs at the axially outermost portion of composite blade profile 39 where a tangent line to the blade profile 39 has a slope of zero. Moving radially outward, adjacent shoulder region 25 is gage region 26, which extends substantially parallel to bit axis 11 at the radially outer periphery of composite blade profile 39. As shown in composite blade profile 39, gage pads 51 define the outer radius 23 of bit 10. Outer radius 23 extends to and therefore defines the full gage diameter of bit 10. As used herein, the term "full gage diameter" refers to the outer diameter of the bit defined by the radially outermost reaches of the cutter elements and surfaces of the bit.

Still referring to FIG. 6, cone region 24, shoulder region 25, and gage region 26 may also be defined by a radial distance measured from, and perpendicular to, bit axis 11. The radial distance defining the bounds of cone region 24, shoulder region 25, and gage region 26 may be expressed as a percentage of outer radius 23. In the embodiment shown in FIG. 4, cone region 24 extends from central axis 11 to about 40% of outer radius 23, shoulder region extends from cone region 24 to about 90% of outer radius 23, and gage region extends from shoulder region 25 to outer radius 23. Cone region 24 may also be defined by the radially innermost end of one or more secondary blades (defined below). In other words, the cone region (e.g., cone region 24) extends from the bit axis to the radially innermost end of one or more secondary blade(s). It should be appreciated that the actual radius of the cone region of a bit measured from the bit's axis may vary from bit to bit depending on a variety of factors including without limitation, bit geometry, bit type, location of one or more secondary blades, location of cutter elements, or combinations thereof. For instance, in some cases the bit (e.g., bit 10) may have a relatively flat parabolic profile resulting in a cone region (e.g., cone region 24) that is relatively large (e.g., 50% of the outer radius). However, in other cases, the bit may have a relatively long parabolic profile resulting in a relatively smaller cone region (e.g., 30% of the outer radius).

Referring back to FIG. 1, depth-of-cut features 108 are intended to limit the depth-of-cut of cutting faces of cutting elements 106 as they engage the formation. In particular, depth of cut features 108 are intended to slide across the formation and limit the depth to which cutting faces bite or penetrate into the formation. As used herein, the limitation of depth of cut by the depth of cut features may still allow further cutting as the weight on bit is increased, but the engagement of the depth of cut features with the formation may alter the rate of torque generated with respect to applied weight on bit. Depending on the formation type, the effect on the slope change upon engagement of depth of cut features may vary. For example, harder rocks may result in a greater effect on the slope or even a zero slope, but softer rocks may have a lesser effect on slope reduction.

Depending on the desired extent of depth of cut limitation intended for depth of cut feature 108 to limit the depth of cut for adjacent cutting elements 106.1 and 106.2, the back-off from the cutting tip 105 of cutting elements 106 may vary. Thus, for example, as the desired maximum depth of cut increases, the axial distance between the cutting tip 105 and the raised depth of cut feature 108 also increases (indicated by blade profile series A, B, and C).

In the embodiment shown in FIG. 1, at least one raised depth of cut feature 108 is provided between each pair of radially adjacent cutting elements 106. In other embodiments, at least two raised depth of cut features 108 may be provided between each pair of radially adjacent cutting elements 106. In yet other embodiments, the number of raised depth of cut features 108 may match the number of cutting elements on the other blades of drill bit (not shown) that are located at radial distances from the bit axis L intermediate that of the cutting elements 106 between which the raised depth of cut feature 108 is located.

Figure 2:
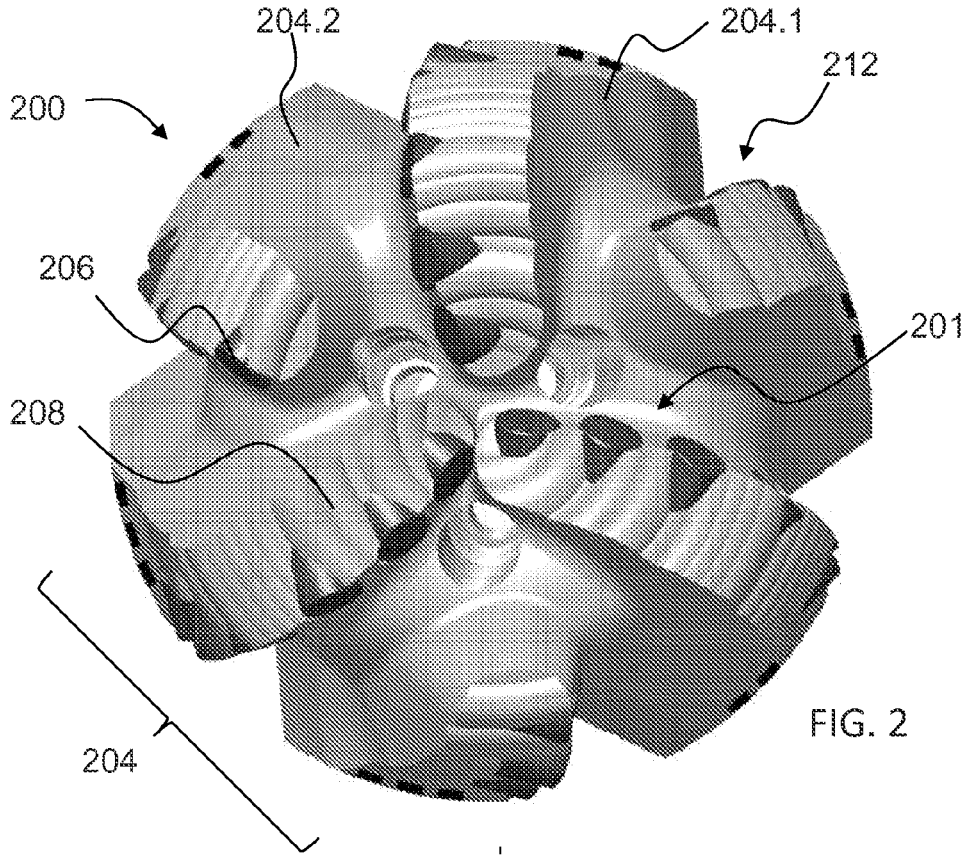
FIG. 2 is a top view of an embodiment of a drill bit.
Figure 3:
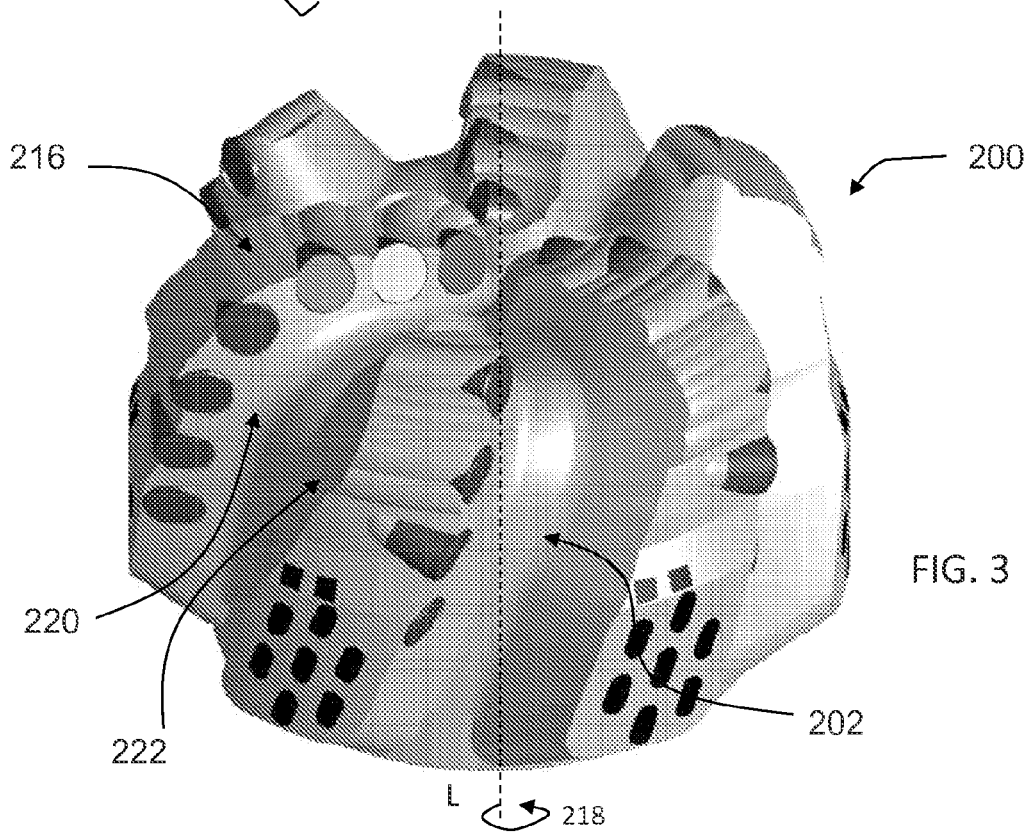
FIG. 3 is a perspective view of an embodiment of a drill bit.

Referring now to FIGS. 2 and 3, a top and perspective view of another embodiment of a drill bit is shown. As shown in FIGS. 2 and 3, drill bit 200 includes a bit body 202, a shank (not shown) and a threaded connection or pin (not shown) for connecting bit 200 to a drill string (not shown), which is employed to rotate the bit in order to drill the borehole. Bit face 201 supports a cutting structure 212 and is formed on the end of the bit 200 that faces the formation and is generally opposite pin end (not shown). Bit 200 further includes a central axis L about which bit 200 rotates in the cutting direction represented by arrow 218. As used herein, the terms "axial" and "axially" generally mean along or parallel to the bit axis (e.g., bit axis L), while the terms "radial" and "radially" generally mean perpendicular to the bit axis. For instance, an axial distance refers to a distance measured along or parallel to the bit axis, and a radial distance refers to a distance measured perpendicularly from the bit axis.

Body 202 may be formed in a conventional manner using powdered metal tungsten carbide particles in a binder material to form a hard metal cast matrix. In one or more other embodiments, the body may be machined from a metal block, such as steel, rather than being formed from a matrix.

Cutting structure 212 includes a plurality of blades 204 which extend from bit face 201. In the embodiment illustrated in FIGS. 2 and 3, cutting structure 212 includes three primary blades 204.1 circumferentially spaced-apart about bit axis L, and three secondary blades 204.2 circumferentially spaced apart about bit axis L.

In this embodiment, primary blades 204.1 and secondary blades 204.2 are circumferentially arranged in an alternating fashion. Thus, one secondary blade 204.2 is disposed between each pair of primary blades 204.1. Further, in this embodiment, the plurality of blades (e.g., primary blades 204.1 and secondary blades 204.2) is uniformly angularly spaced on bit face 201 about bit axis L. In particular, the three primary blades 204.1 are uniformly angularly spaced about 120° apart, and the three secondary blades 204.2 are uniformly angularly spaced about 120° and each primary blade 204.1 is angularly spaced about 60° from each circumferentially adjacent secondary blade 204.2. In other embodiments, one or more of the primary and/or secondary blades (e.g., blades 204.1 or 204.2) may be non-uniformly angularly spaced about the bit face (e.g., bit face 201). Moreover, although bit 200 is shown as having three primary blades 204.1 and three secondary blades 204.2, in general, bit 200 may comprise any suitable number of primary and secondary blades. As one example (i.e., other configurations may be used), bit 200 may comprise two primary blades and four secondary blades. Thus, as used herein, the term "primary blade" refers to a blade that begins proximal the bit axis and extends generally radially outward along the bit face to the periphery of the bit. However, secondary blades 204.2 are not positioned proximal bit axis L, but rather, begin at a location that is distal bit axis L and extend radially along bit face 201 toward the radially outer periphery of bit 200.

In the embodiment illustrated in FIGS. 2 and 3, the blade tops or formation facing surfaces 216 of blades 204 include a plurality of depth of cut features 208 thereon. Specifically, the plurality of depth of cut features 208 is disposed between radially adjacent cutters 206. Depending on the location of the cutting elements 206 on the blade 204, at least one depth of cut feature may be included between a pair of radially adjacent cutters 206. In another embodiment, at least two depth of cut features 208 may be included between a pair of radially adjacent cutters 206. In yet another embodiment, the number of depth of cut features 208 between a pair of radially adjacent cutters 206 may be dependent on the number of cutting elements 206 on the other blade(s) 204 located at radial distances from the bit axis L between or intermediate the radial distances from the bit axis of the pair of radially adjacent cutters. Further, one of ordinary skill in the art would appreciate after reading the teachings of the present disclosure that, in such embodiments, the radially interior portion of the primary blades 204.1 may thus have fewer depth of cut features 208 between pairs of radially adjacent cutters as compared to radially outward portions of the primary blades 204.1 due to the introduction of cutting elements on secondary blades 204.2, which increases the number of cutting elements 206 on the other blade(s) 204 located at radial distances from the bit axis L between or intermediate the radial distances from the bit axis of a given pair of radially adjacent cutters 206. Further, in one or more embodiments, the plurality of depth of cut features 208 do not just correspond in number to the cutting elements 206 on the other blades 204 located at radial distances from the bit axis L between or intermediate the radial distances from the bit axis L of a given pair of radially adjacent cutters 206, but the plurality of depth of cut features 208 also correspond to the radial location (from the bit axis L) to such cutting elements 206 on the other blades 204.

In one or more embodiments, the plurality of depth of cut features 208 is present in a cone region of a blade 204. In one or more embodiments, the plurality of depth of cut features 208 is present in a nose region of a blade 204. In one or more embodiments, the plurality of depth of cut features 208 is present in a shoulder region of a blade 204. Further, various combinations of depth of cut features 208 being present in two or more of the cone, nose, or shoulder region of the blades 204 is also within the scope of the present disclosure. In one or more embodiments, there are no raised depth of cut features 208 in at least a portion of a gage region of a blade 204.

As illustrated, the depth of cut features 208 extend along the blades' 204 formation facing surfaces 216 from a leading face 220 of the blade 204 rearward to the trailing face 222 of blade 204. However, it is also within the scope of the present disclosure that the depth of cut features 208 does not have to extend the entire width of formation facing surface 216, but may instead extend less than the entire width and not intersect the leading face 220 and/or the trailing face 222. Thus, in one or more embodiments, the raised depth of cut feature 208 extends along the formation facing surface 216 from the leading face 220 rearward in the direction of the trailing face 222, but stops short of the trailing face 222. Conversely, in one or more embodiments, the raised depth of cut feature 208 extends along the formation facing surface 216 from rearward of the leading face 220 in the direction of the trailing face 222, and may either stop short of trailing face 222 or may extend to and intersect trailing face 222.

Further, in the embodiment shown in FIGS. 2 and 3, the plurality of depth of cut features 208 include curvature along the radial direction of the features 208. In one or more embodiments such radius curvature may be substantially the same as the cutting element 206 on another blade 204 to which the depth of cut feature 208 corresponds, i.e., is at the same radial distance from the bit axis L as such cutting element 206.

In addition (or instead of) to the radially extending curvature of the raised depth of cut features 208, in one or more embodiments, at least one depth of cut feature 208 also possess curvature circumferentially bit axis L or in the direction of bit rotation. Thus, in such embodiments, at least one depth of cut feature 208 may extend arcuately in the direction of rotation of the bit 200 about the bit axis L.

In one or more embodiments, the shape and profile of one or more depth of cut features 208 may correspond to the bottom hole pattern, i.e., the pattern created on a formation bottom hole as a cutting element shears the formation due to bit rotation and application of weight on the bit, of the corresponding cutting element 206 at a selected depth of cut. For example, referring back to FIG. 1, as the desired depth of cut changes, the profile of the depth of cut features 108 may similarly change because the depth of cut will alter the bottom hole pattern of the cutting elements 108. When drilling through a formation, one skilled in the art would appreciate that the weight on bit is applied to have a desired level of depth of cut of the cutting elements into the formation. However, during the normal drilling process, there may be occurrences of sudden or instantaneous increases in the depth of cut, for example, as the formation type or downhole conditions may change. The incorporation of the depth of cut features of the present disclosure may assist in reducing and/or preventing such instances of instantaneous or sudden increases in the depth of cut and maintain more uniform depth of cut during the drilling process. Additionally, by keeping depth of cut more uniform, the bit may experience less torque increase with increasing weight on bit.

Figure 4:
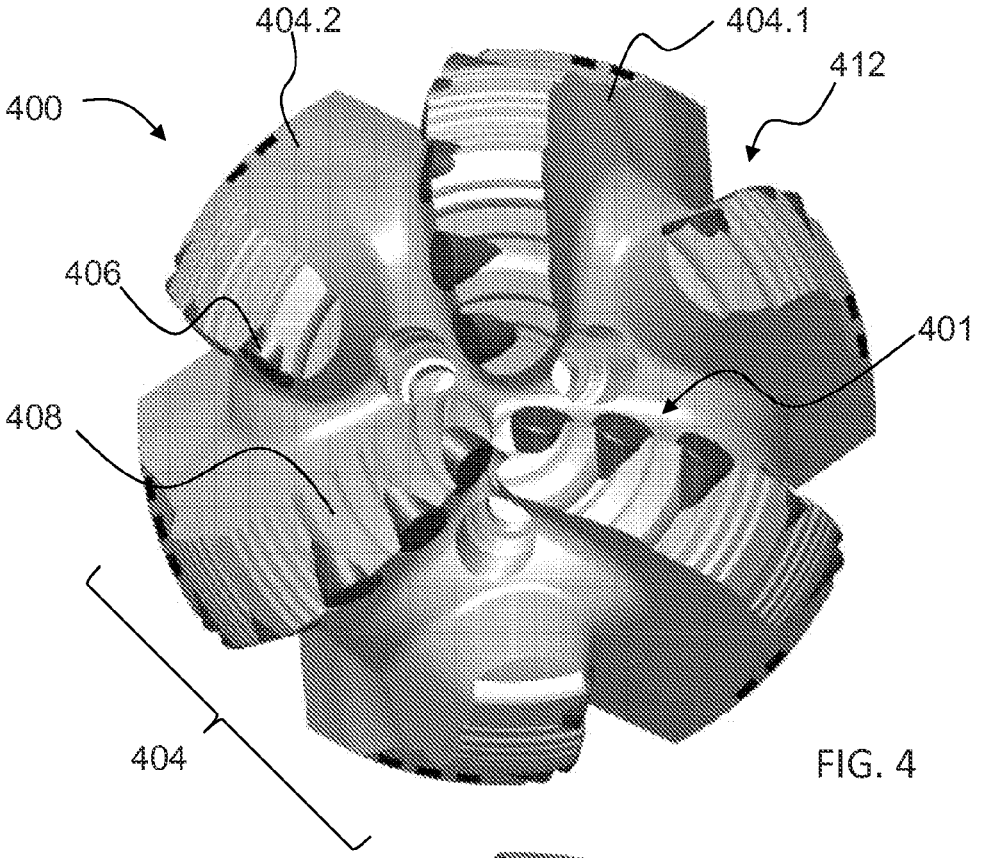
FIG. 4 is a top view of an embodiment of a drill bit.
Figure 5:
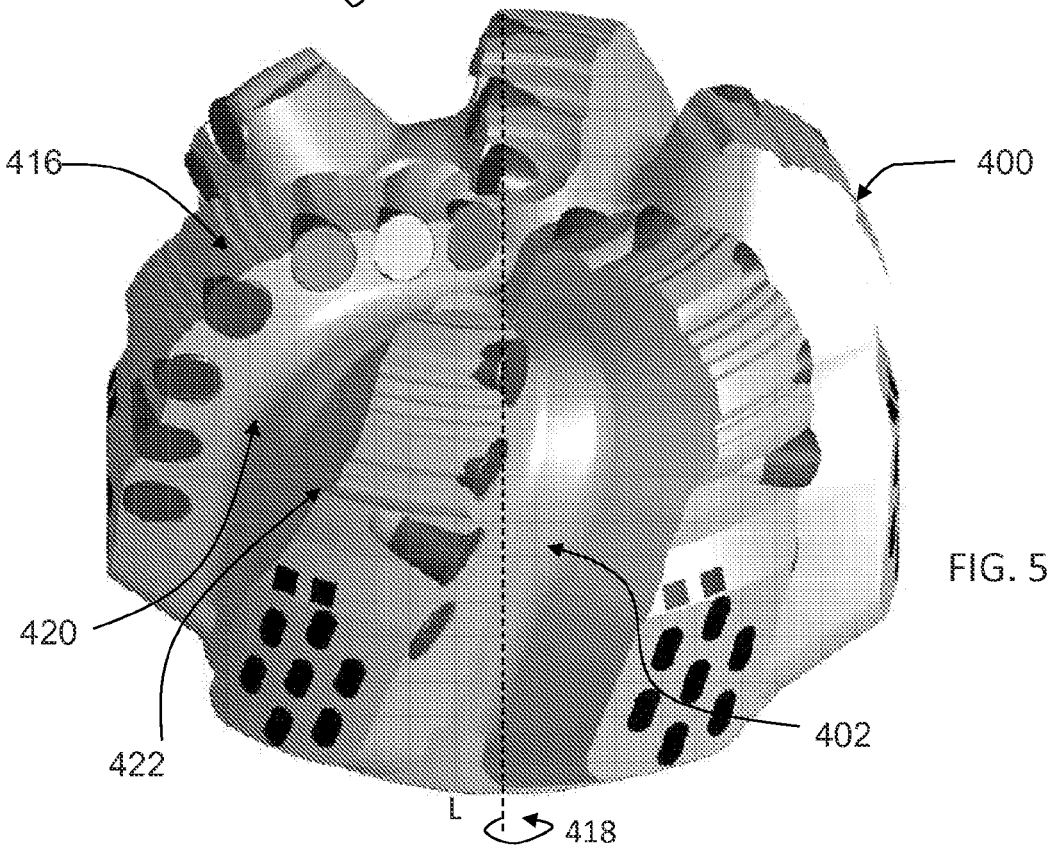
FIG. 5 is a perspective view of an embodiment of a drill bit.

Referring now to FIGS. 4 and 5, a top and perspective view of another embodiment of a drill bit is shown. As shown in FIGS. 4 and 5, drill bit 400 includes a bit body 402, a shank (not shown) and a threaded connection or pin (not shown) for connecting bit 400 to a drill string (not shown), which is employed to rotate the bit in order to drill the borehole. Bit face 401 supports a cutting structure 412 and is formed on the end of the bit 400 that faces the formation and is generally opposite pin end (not shown). Bit 400 further includes a central axis L about which bit 400 rotates in the cutting direction represented by arrow 418.

Body 402 may be formed in a conventional manner using powdered metal tungsten carbide particles in a binder material to form a hard metal cast matrix. In one or more other embodiments, the body may be machined from a metal block, such as steel, rather than being formed from a matrix. Cutting structure 412 includes a plurality of blades 404 which extend from bit face 401.

In the embodiment illustrated in FIGS. 4 and 5, the blade tops or formation facing surfaces 416 of blades 404 include a plurality of depth of cut features 408 thereon. Specifically, the plurality of depth of cut features 408 is disposed between radially adjacent cutters 406. Depending on the location of the cutting elements 406 on the blade 404, at least one depth of cut feature 408 may be included between a pair of radially adjacent cutters 406. In another embodiment, at least two depth of cut features 408 may be included between a pair of radially adjacent cutters 406. In yet another embodiment, the number of depth of cut features 408 between a pair of radially adjacent cutters 406 may be dependent on the number of cutting elements 406 on the other blade(s) 404 located at radial distances from the bit axis L between or intermediate the radial distances from the bit axis of the pair of radially adjacent cutters.

In contrast to the embodiment illustrated in FIGS. 2 and 3, in the embodiment illustrated in FIGS. 4 and 5, the plurality of depth of cut features 408 include a substantially planar surface at the apex along the radial direction of the features 408. In one or more embodiments such radius curvature may be substantially the same as the cutting element 406 on another blade 404 to which the depth of cut feature 408 corresponds, i.e., is at the same radial distance from the bit axis L as such cutting element 406.

In the embodiment illustrated in FIGS. 4 and 5, cutting structure 412 includes three primary blades 404.1 circumferentially spaced-apart about bit axis L, and three secondary blades 404.2 circumferentially spaced apart about bit axis L. In this embodiment, primary blades 404.1 and secondary blades 404.2 are circumferentially arranged in an alternating fashion. Thus, one secondary blade 404.2 is disposed between each pair of primary blades 404.1. Further, in this embodiment, the plurality of blades (e.g., primary blades 404.1 and secondary blades 404.2) is uniformly angularly spaced on bit face 401 about bit axis L. In particular, the three primary blades 404.1 are uniformly angularly spaced about 120° apart, and the three secondary blades 404.2 are uniformly angularly spaced about 120° and each primary blade 404.1 is angularly spaced about 60° from each circumferentially adjacent secondary blade 404.2. In other embodiments, one or more of the primary and/or secondary blades (e.g., blades 404.1 or 404.2) may be non-uniformly angularly spaced about the bit face (e.g., bit face 401). Moreover, although bit 400 is shown as having three primary blades 404.1 and three secondary blades 404.2, in general, bit 400 may comprise any suitable number of primary and secondary blades. As one example, bit 240 may comprise two primary blades and four secondary blades.

Further, one of ordinary skill in the art would appreciate after reading the teachings of the present disclosure that, in such embodiments, the radially interior portion of the primary blades 404.1 may thus have fewer depth of cut features 408 between pairs of radially adjacent cutters as compared to radially outward portions of the primary blades 404.1 due to the introduction of cutting elements on secondary blades 404.2, which increases the number of cutting elements 206 on the other blade(s) 404 located at radial distances from the bit axis L between or intermediate the radial distances from the bit axis of a given pair of radially adjacent cutters 406. Further, in one or more embodiments, the plurality of depth of cut features 408 do not just correspond in number to the cutting elements 406 on the other blades 404 located at radial distances from the bit axis L between or intermediate the radial distances from the bit axis L of a given pair of radially adjacent cutters 406, but the plurality of depth of cut features 408 also correspond to the radial location (from the bit axis L) to such cutting elements 406 on the other blades 404.

In one or more embodiments, the plurality of depth of cut features 408 is present in a cone region of a blade 404. In one or more embodiments, the plurality of depth of cut features 408 is present in a nose region of a blade 404. In one or more embodiments, the plurality of depth of cut features 408 is present in a shoulder region of a blade 404. Further, various combinations of depth of cut features 408 being present in two or more of the cone, nose, or shoulder region of the blades 404 is also within the scope of the present disclosure. In one or more embodiments, there are no raised depth of cut features 408 in at least a portion of a gage region of a blade 404.

As illustrated, the depth of cut features 408 extend along the blades' 404 formation facing surfaces 416 from a leading face 420 of the blade 404 rearward to the trailing face 422 of blade 404. However, it is also within the scope of the present disclosure that the depth of cut features 408 does not have to extend the entire width of formation facing surface 416, but may instead extend less than the entire width and not intersect the leading face 420 and/or the trailing face 422. Thus, in one or more embodiments, the raised depth of cut feature 408 extends along the formation facing surface 416 from the leading face 420 rearward in the direction of the trailing face 422, but stops short of the trailing face 422. Conversely, in one or more embodiments, the raised depth of cut feature 408 extends along the formation facing surface 416 from rearward of the leading face 420 in the direction of the trailing face 422, and may either stop short of trailing face 422 or may extend to and intersect trailing face 422.

Further, in one or more embodiments, at least one depth of cut feature 408 also possess curvature circumferentially bit axis L or in the direction of bit rotation. Thus, in such embodiments, at least one depth of cut feature 408 may extend arcuately in the direction of rotation of the bit 400 about the bit axis L.

In one or more embodiments, the shape and profile of one or more depth of cut features 408 may correspond to the bottom hole pattern, i.e., the pattern created on a formation bottom hole as a cutting element shears the formation due to bit rotation and application of weight on the bit, of a worn corresponding cutting element 406 at a selected depth of cut. For example, referring back to FIG. 1, as the desired depth of cut changes, the profile of the depth of cut features 108 may similarly change because the depth of cut will alter the bottom hole pattern of the cutting elements 108. When drilling through a formation, one skilled in the art would appreciate that the weight on bit is applied to have a desired level of depth of cut of the cutting elements into the formation. However, during the normal drilling process, there may be occurrences of sudden or instantaneous increases in the depth of cut, for example, as the formation type or downhole conditions may change. The incorporation of the depth of cut features of the present disclosure may assist in reducing and/or preventing such instances of instantaneous or sudden increases in the depth of cut and maintain more uniform depth of cut during the drilling process. Additionally, by keeping depth of cut more uniform, the bit may experience less torque increase with increasing weight on bit.

The bottom hole pattern for a particular cutting element layout and profile, described with respect to the embodiments illustrated in FIGS. 2-5, may be generated in one of several ways, including, for example, through creation of an actual bottom hole pattern using a bit having the particular cutting element layout and profile or through a simulation. For example, a bottom hole profile may be simulated based on a bit model using the methods described in U.S. Pat. No. 7,693,695, which is assigned to the present assignee and herein incorporated by reference in its entirety. Once the bottom hole pattern is determined (through actual drilling or simulated drilling), it may be transposed onto a bit during manufacture of the bit, such as through the mold used in making the bit or through tooling of a previously casted or molded bit. For a depth of cut features reflecting a bottom hole pattern corresponding to worn cutting elements, the wear of cutting elements may be determined through actual drilling or by simulation of cutting element wear and the corresponding bottom hole pattern using the methods described in U.S. Pat. No. 7,693,695 and U.S. Patent Publication No. 2005/0015229, which is assigned to the present assignee and herein incorporated by reference in its entirety. In a particular embodiment, the wear profile may be generated based on a maximum wear amount for any cutting element, and then determining the wear on the remaining cutting elements accordingly. In one or more embodiments, the maximum wear ranges from 0.25 mm to 2 mm and between 0.5 and 1.5 mm in other embodiments, and between about 0.75 and 1.25 mm in yet other embodiments.

In the embodiments described above, the depth of cut features are described without reference to any depth of cut values. First, it is noted that the desired depth of cut may depend, for example, on the type of formation being drilling, downhole conditions, cutter size, cutter type, etc. However, the depth of cut may range, in some embodiments, from greater than 2 mm to up to 5 mm in some embodiments. Other embodiments may use a lower limit of any of 1 mm, 2 mm, 3 mm, 4 mm or 5 mm, and an upper limit of any of 3 mm, 4 mm, 5 mm, 6 mm, 7 mm or 8 mm, where any lower limit can be used in combination with any upper limit.

Figure 7A:
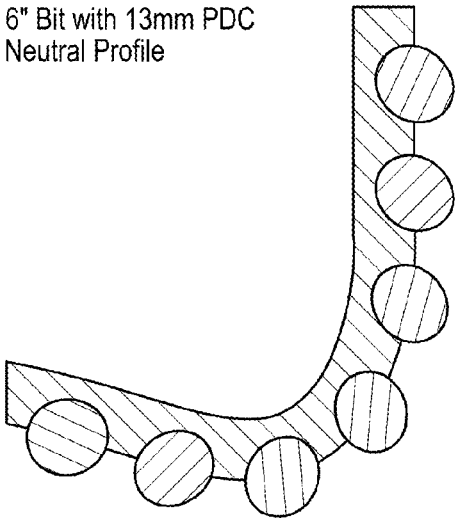
FIGS. 7A-B show conventional blade profiles.
Figure 7B:
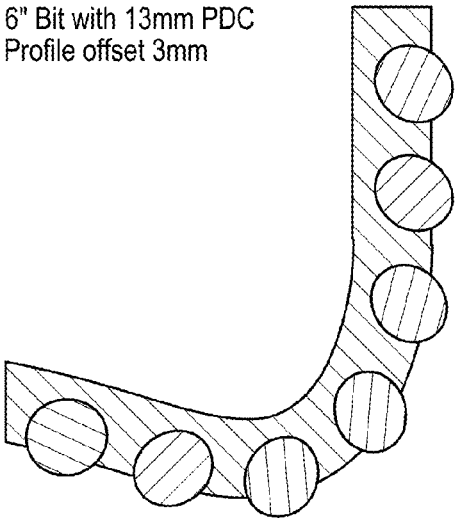
Figure 7C:
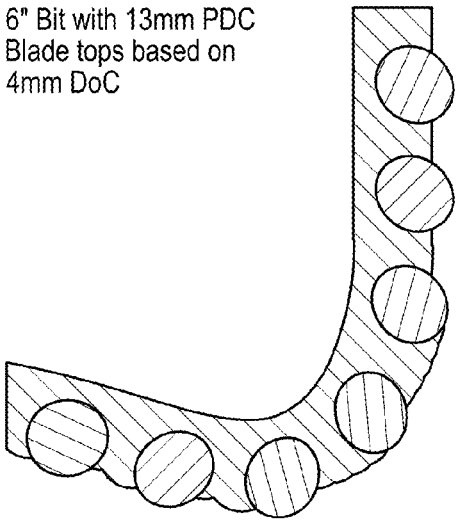
FIGS. 7C-D show blade profiles according to embodiments of the present disclosure.

Referring now to FIGS. 7A-D, a comparison of a conventional blade profile (the blade formation facing surface being located at approximately the cutter diameter) in FIG. 7A, a high profile conventional blade profile with a 3 mm offset in FIG. 7B, a blade having depth of cut features corresponding to a bottom hole profile with a 4 mm depth of cut in FIG. 7C, and a blade having depth of cut features corresponding to a bottom hole profile of 1 mm maximum worn cutters with a 4 mm depth of cut.

Figure 7D:
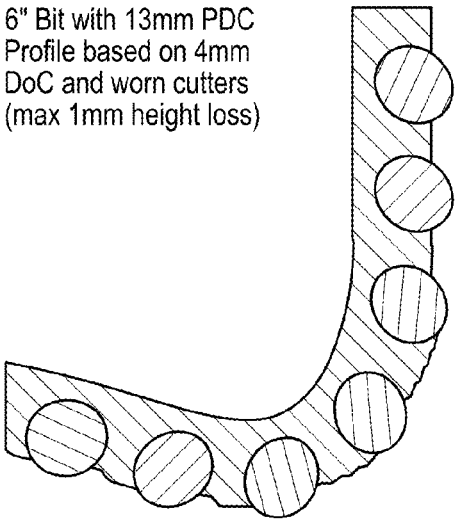
Figure 8A:
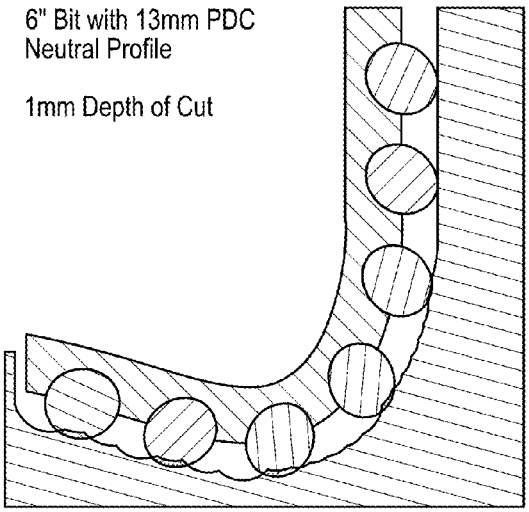
FIGS. 8A-D show the blade profiles of FIGS. 7A-D at 1 mm depth of cut.
Figure 8B:
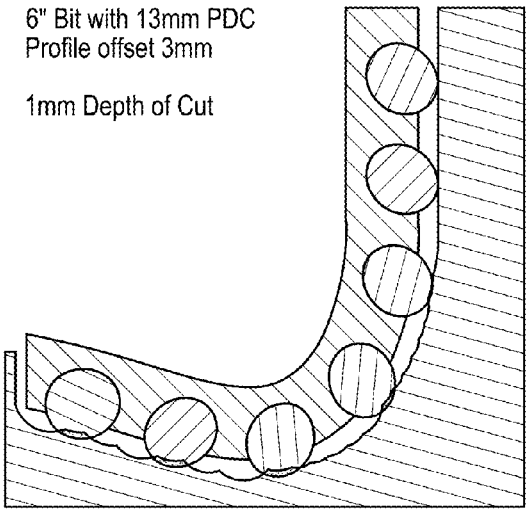
Figure 8C:
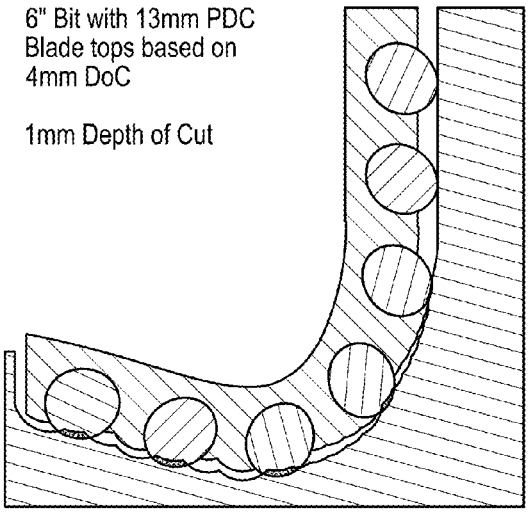
Figure 8D:
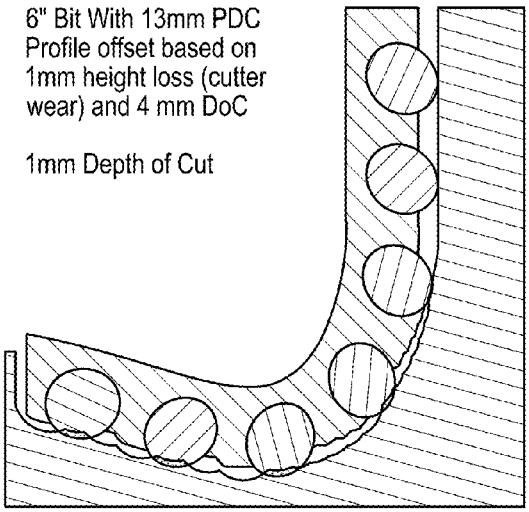
Figure 9A:
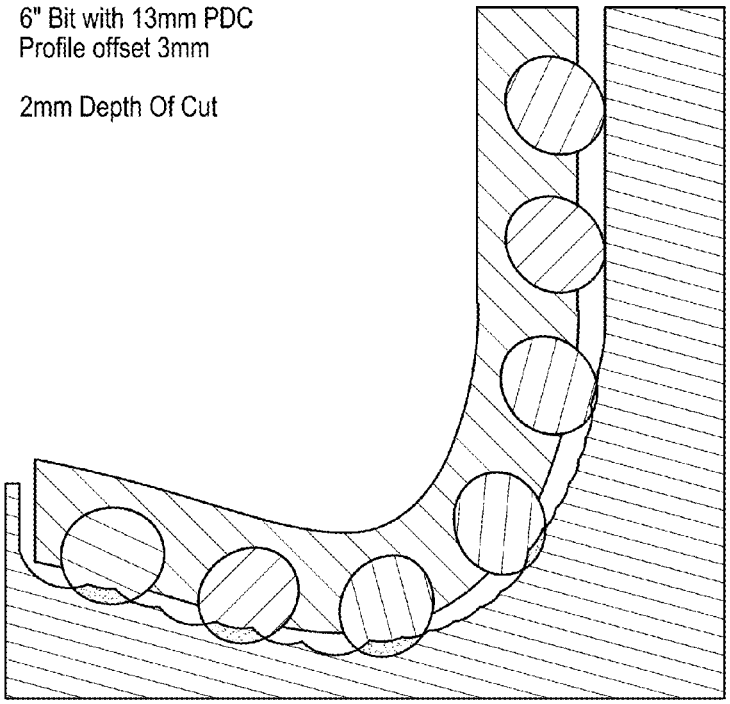
FIGS. 9A-C show the blade profiles of FIGS. 7B-D at 2 mm depth of cut.
Figure 9B:
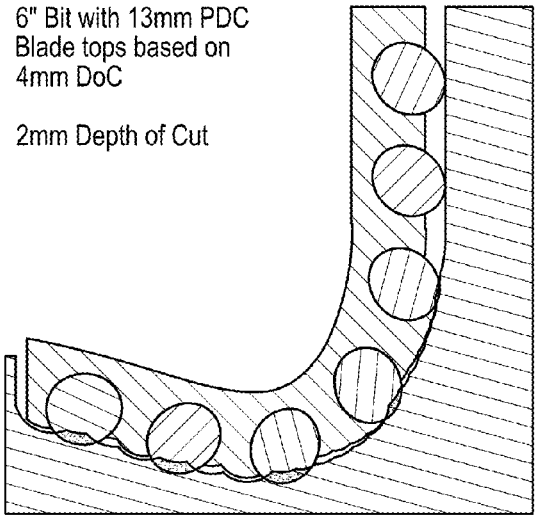
Figure 9C:
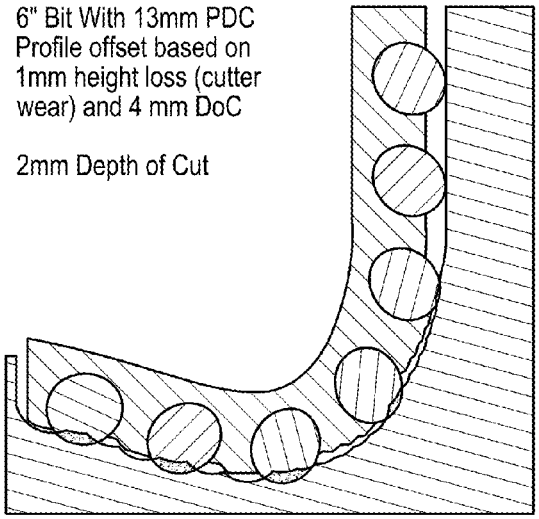
Figure 10A:
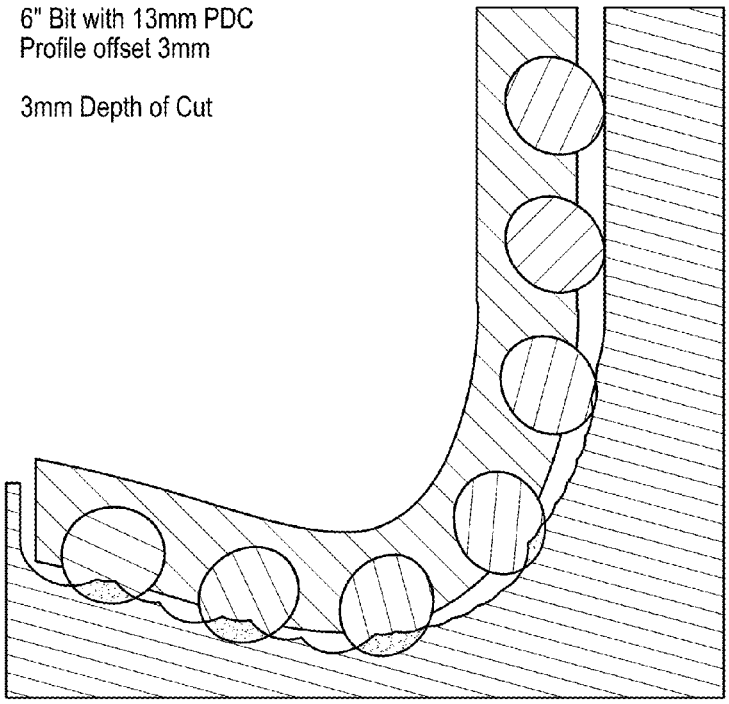
FIGS. 10A-C show the blade profiles of FIGS. 7B-D at 3 mm depth of cut.
Figure 10B:
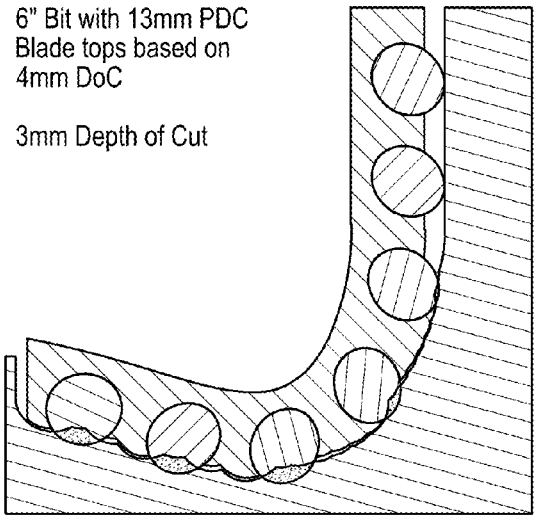
Figure 10C:
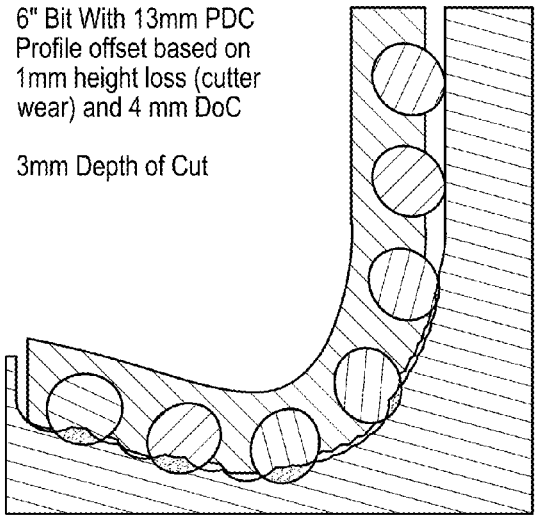
Figure 11A:
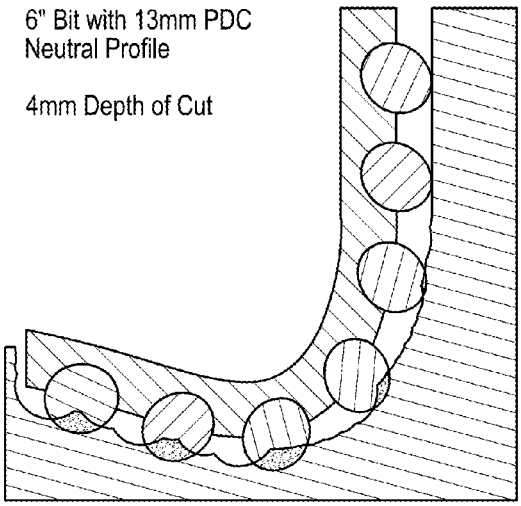
FIGS. 11A-D show the blade profiles of FIGS. 7A-D at 4 mm depth of cut.
Figure 11B:
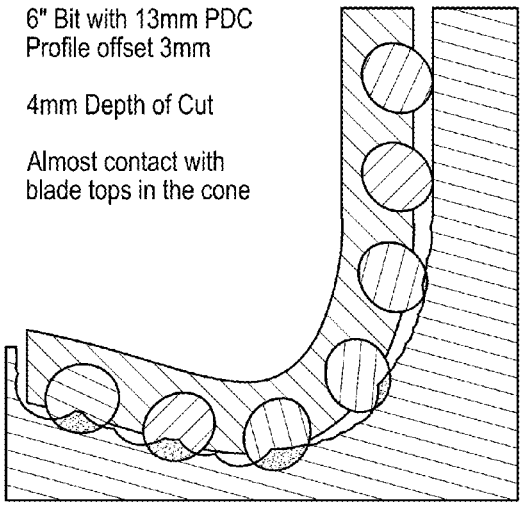
Figure 11C:
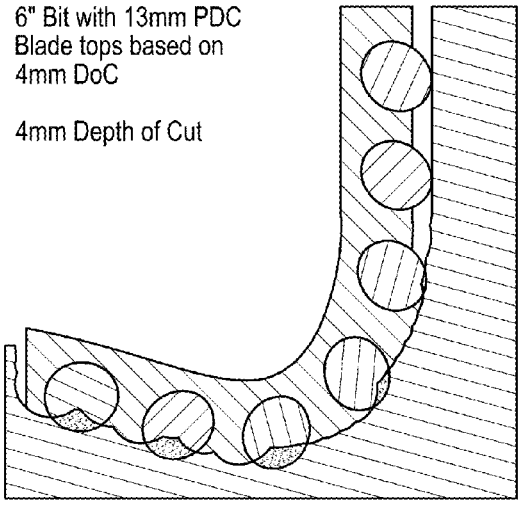
Figure 11D:
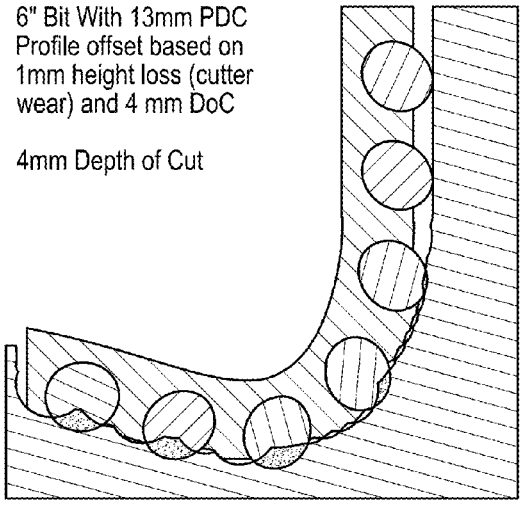
Figure 12A:
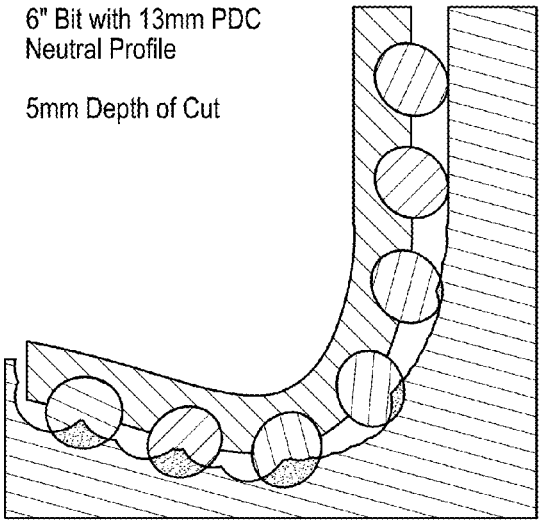
FIGS. 12A-D show the blade profiles of FIGS. 7A-D at 5 mm depth of cut.
Figure 12B:
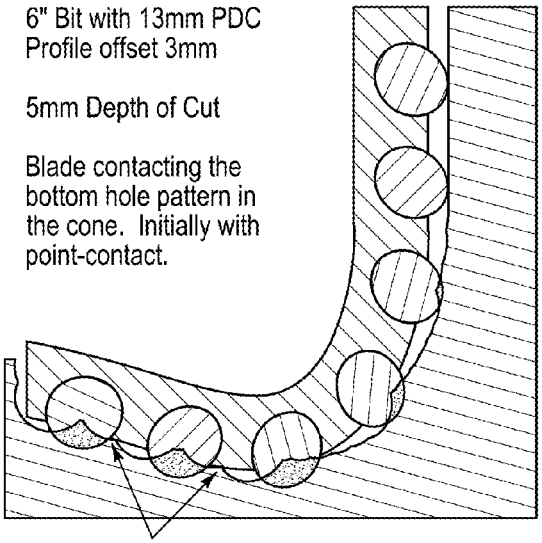
Figure 12C:
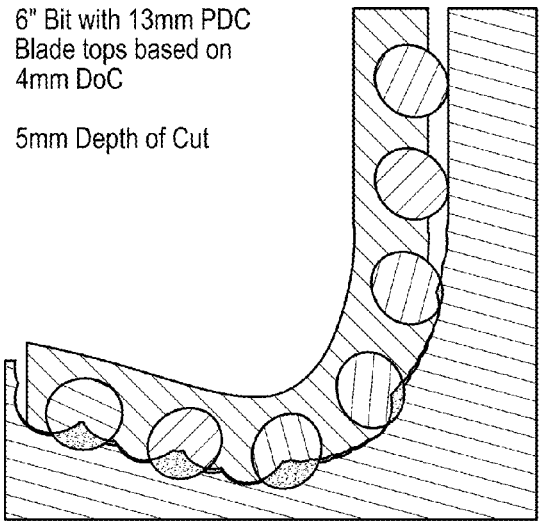
Figure 12D:
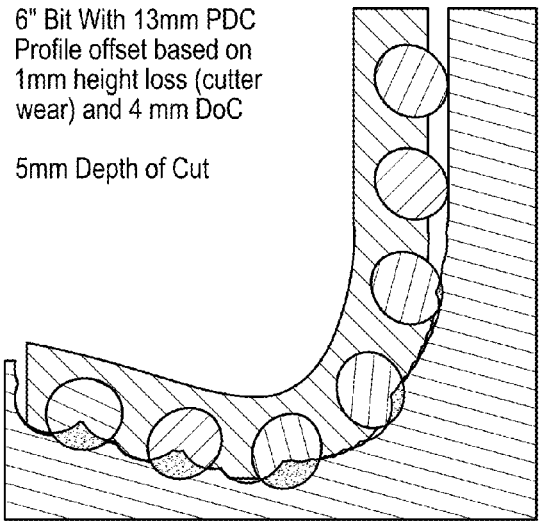

Referring now to FIGS. 8A-D, the blades shown in FIGS. 7A-D are shown interacting with a formation at a 1 mm depth of cut. Referring now to FIGS. 9A-C and 10A-C, the blades shown in FIGS. 7B-D are shown interacting with a formation at a 2 mm depth of cut and a 3 mm depth of cut, respectively. Referring now to FIGS. 11A-D and 12A-D, the blades shown in FIGS. 7A-D are shown interacting with a formation at a 4 mm depth of cut and a 5 mm depth of cut, respectively.

Figure 13A:
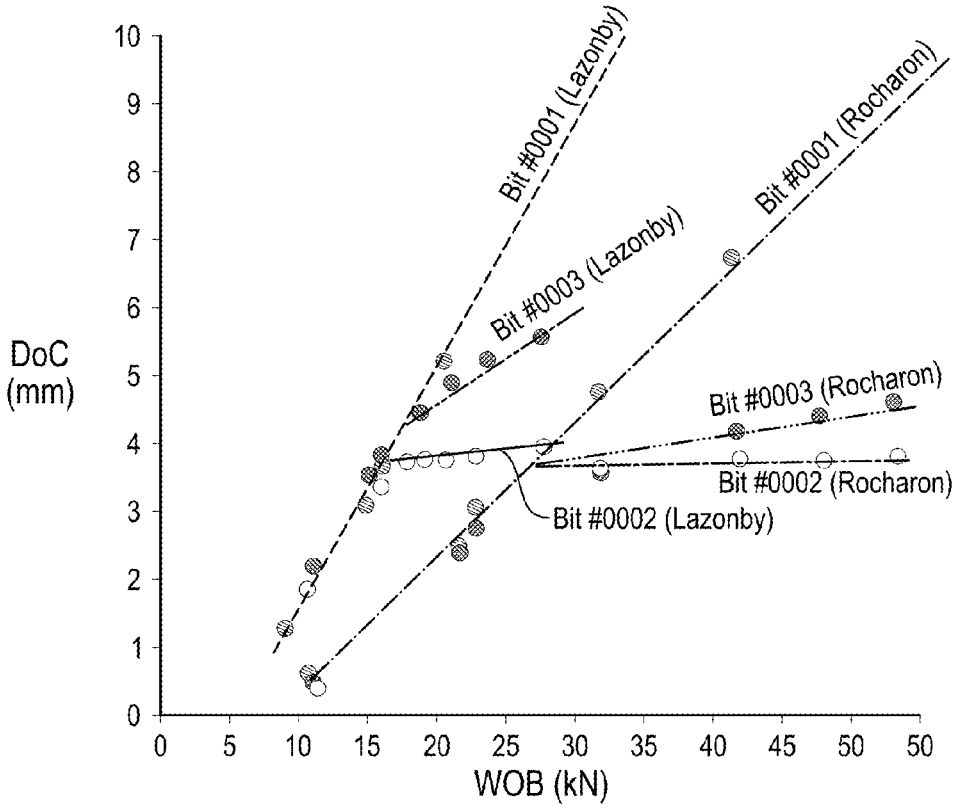
FIG. 13A shows a plot of depth of cut versus weight on bit for drill bits drilled through two formation types.
Figure 13B:
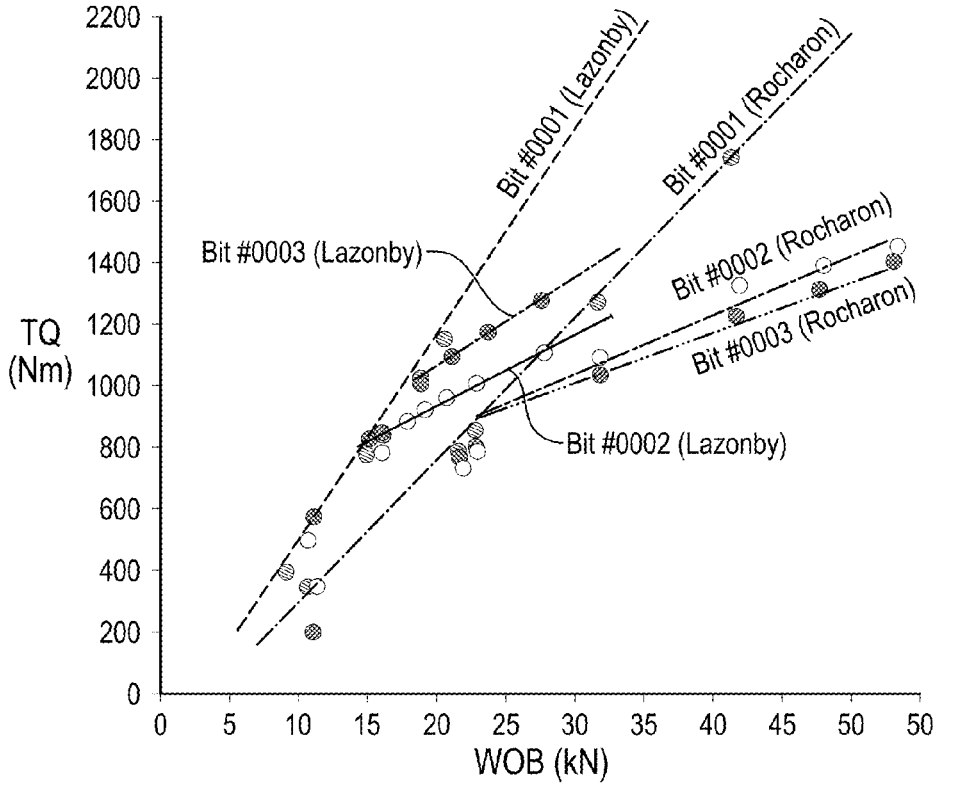
FIG. 13B shows a plot of torque versus weight on bit for drill bits drilled through two formation types.
Figure 14A:
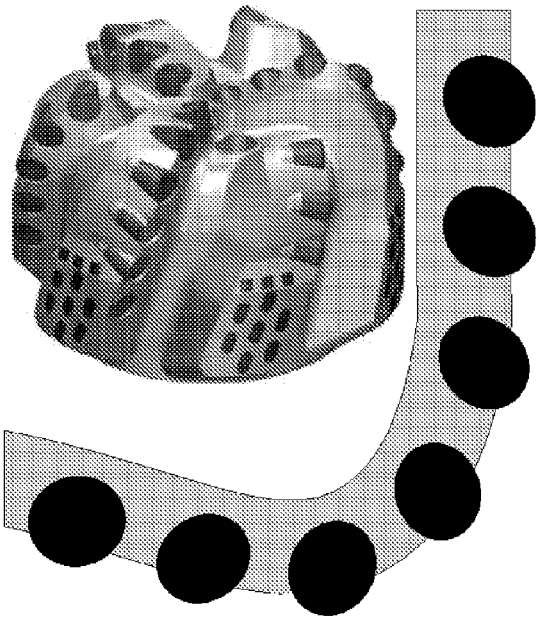
FIGS. 14A-C show illustrations of the bits (and blade profile) of the drill bits used to generate the data presented in FIGS. 13A-B.
Figure 14B:
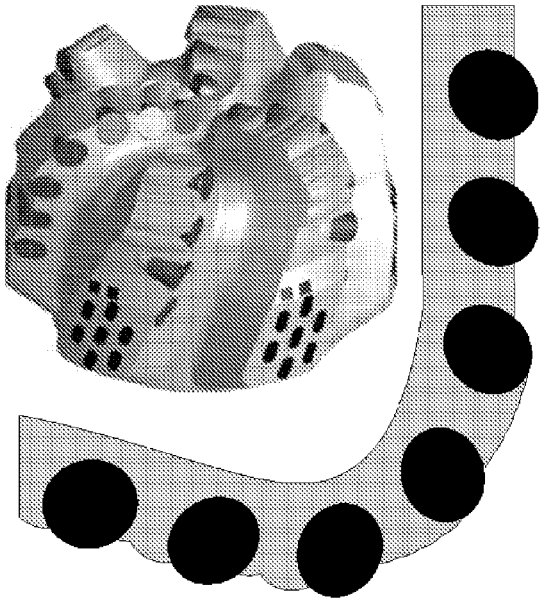
Figure 14C:
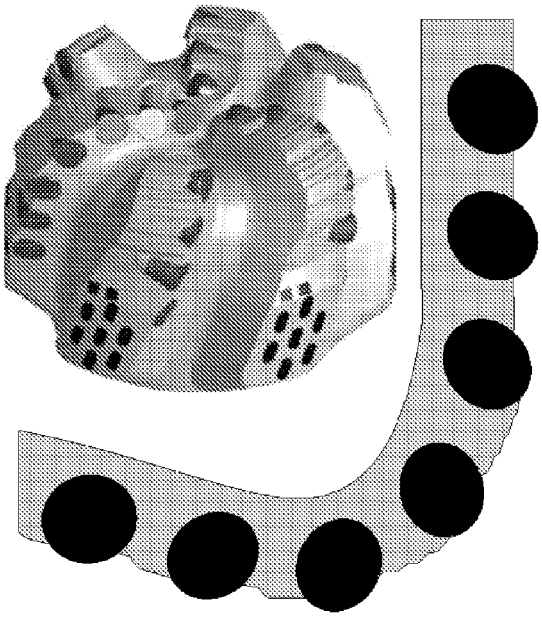

Referring now to FIGS. 13A-B, the results of the bits illustrated in FIGS. 14A-B being drilled in Lazonby (8 kpsi sandstone) and Rocheron (18 kpsi limestone). FIG. 13A shows a plot of depth of cut versus weight on bit, and FIG. 13B shows a plot of torque versus weight on bit. FIG. 14A corresponds to "Bit #0001" shown in FIGS. 13A-B, and has a blade top profile that is offset 2 mm from neutral (neutral is through the cutter centers). FIG. 14B corresponds to "Bit #0002" shown in FIGS. 13A-B and has a blade top profile based on the bottom hole pattern generated by new cutters at a 4 mm depth of cut. FIG. 14C corresponds to "Bit #0003" shown in FIGS. 13A-B and has a blade top profile based on the bottom hole pattern generated by worn cutters (to a 1 mm maximum height loss) at a 4 mm depth of cut.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A drill bit for drilling a borehole in an earthen formation, the bit comprising:

a bit body having a bit axis and a direction of rotation about the bit axis;

at least three blades attached to the bit body, the at least three blades having a leading face facing the direction of rotation of the bit body about the bit axis, a trailing face facing away from the direction of rotation of the bit body about the bit axis, and a formation facing surface extending between the leading face and the trailing face; and a plurality of cutting elements disposed on the at least three blades, each cutting element having a radial distance from the bit axis, wherein a first blade, at its leading face, comprises, between first and second radially adjacent cutting elements on the first blade, a raised depth of cut feature for a third cutting element on a second blade and a fourth cutting element on a third blade, the third and fourth cutting elements being at radial distances from the bit axis intermediate the radial distances from the bit axis of the radially adjacent first and second cutting elements, the raised depth of cut feature comprising a first apex corresponding to the third cutting element and a second apex corresponding to the fourth cutting element.

2. The drill bit of claim 1, wherein the raised depth of cut feature comprises a first radius of curvature substantially the same as the third cutting element and a second radius of curvature substantially the same as the fourth cutting element.

3. The drill bit of claim 1, wherein the raised depth of cut feature comprises a substantially planar surface.

4. The drill bit of claim 1, wherein the raised depth of cut feature extends along the formation facing surface from the leading face rearward in the direction of the trailing face.

5. The drill bit of claim 4, wherein the raised depth of cut feature extends from the leading face to the trailing face.

6. The drill bit of claim 1, wherein the raised depth of cut feature extends along the formation facing surface from rearward of the leading face in the direction of the trailing face.

7. The drill bit of claim 6, wherein the raised depth of cut feature extends from rearward of the leading face to the trailing face.

8. The drill bit of claim 6, wherein the raised depth of cut feature extends from rearward of the radially adjacent cutting elements.

9. The drill bit of claim 1, wherein the raised depth of cut feature extends arcuately in the direction of rotation of the drill bit about the bit axis.

10. The drill bit of claim 1, wherein the raised depth of cut feature is located on the first blade in at least one of a cone, nose, or shoulder region of the cutting profile.

11. The drill bit of claim 10, wherein the raised depth of cut feature is located on the first blade in at least two of a cone, nose, or shoulder region of the cutting profile.

12. The drill bit of claim 1, wherein the raised depth of cut feature corresponds to an expected bottom hole pathway for the corresponding cutting element at the radial distance of the raised depth of cut feature.

13. A method of drilling a borehole in an earthen formation comprising:

(a) providing a drill bit of claim 1;

(b) engaging the formation with the drill bit after (a);

(c) penetrating the formation with the plurality of cutting elements to a depth-of-cut; and (d) limiting the depth of cut with the raised depth of cut feature.

* * * * *